United States Patent [19]

Kasahara et al.

[11] 4,168,424

[45] Sep. 18, 1979

[54] THERMAL FIXING METHOD FOR A COPYING MACHINE UTILIZING A HEATING ROLLER

[75] Inventors: Junkichi Kasahara; Tsuneo Matsuzaki, both of Hachioji, Japan

[73] Assignee: Konishiroku Photo Industry Co., Ltd., Tokyo, Japan

[21] Appl. No.: 863,172

[22] Filed: Dec. 22, 1977

[30] Foreign Application Priority Data

Dec. 27, 1976 [JP] Japan ..... 51-160200

[51] Int. Cl.[2] ..... G03G 5/00

[52] U.S. Cl. ..... 219/469; 355/3 FU; 355/132; 432/60; 432/228

[58] Field of Search ..... 219/469–471, 219/216; 432/60, 228; 355/3 FU

[56] References Cited

U.S. PATENT DOCUMENTS

| | | | |
|---|---|---|---|
| 3,754,819 | 8/1973 | Braun | 432/60 |
| 3,861,863 | 1/1975 | Kudsi | 432/60 |
| 3,907,493 | 9/1975 | Thettu | 432/60 |
| 3,908,589 | 9/1975 | Bar-On | 432/60 |
| 3,951,585 | 3/1976 | Fujimoto | 432/60 |
| 3,998,584 | 12/1976 | Wada et al. | 219/469 |
| 4,081,213 | 3/1978 | Bar-On et al. | 432/228 |

*Primary Examiner*—Roy N. Envall, Jr.
*Assistant Examiner*—Bernard Roskoski
*Attorney, Agent, or Firm*—Bierman & Bierman

[57] ABSTRACT

A method and apparatus for controlling a copying machine of the type in which a toner image bearing member is passed between heating and pressure rollers for thermally fixing the toner image on such member, in which the rollers are rotated under low pressure by a reversible sub-motor; upon initiating a copying action under high pressure a main motor is used to drive both the rollers and the paper feeding mechanism, while the sub-motor is reversed to actuate a high-pressure forming mechanism. At the end of the copying action, the main motor is cut out and the sub-motor again reversed to its original direction to rotate the rollers under low pressure; rotation of the rollers by the sub-motor may be at a lower speed than when they are driven by the main motor.

12 Claims, 5 Drawing Figures

THERMAL FIXING METHOD FOR A COPYING MACHINE UTILIZING A HEATING ROLLER

Figure 1:
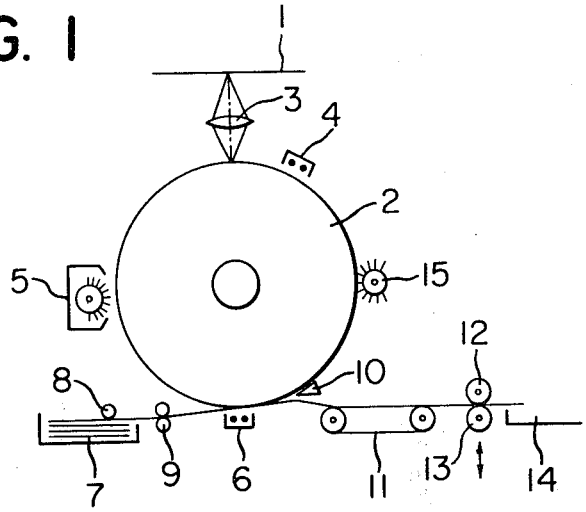

This invention relates to an improvement in a thermal fixing method for a copying machine utilizing a heating roller, and apparatus for carrying out such method.

A copying machine utilizing a heating roller is of the type in which a toner image bearing member is generally passed through between the heating roller and a pressure roller, and the toner images are thermally fixed on its bearing member, while the toner image bearing member is eventually fed towards a paper exhausting port by rotating the rollers. This applies to the case where the toner image is fixed directly on a photosensitive paper as well as the case where the toner image is fixed onto a transfer sheet.

In such a case, each heating roller makes linear contact with the toner image and thus a fixing effect is substantially determined by the temperature, as well as the rotation speed of the rollers and extent of contact of the heating roller with the pressure roller. Therefore, in case it is desired in a high speed copying machine to increase the fixing speed, it is necessary either to raise the roller temperature or to increase the extent of contact between both rollers. As there is also the requirement on the one hand that electric power consumed by the copying machine be minimized, the problem is generally solved by way of increasing the contact pressure between the two rollers. However, the pressure roller normally has its surface covered with hard rubber or the like and if the contact pressure between the rollers is increased without any countermeasure, the surface of the hard rubber may deform while the machine is at rest or there is a long period of time between successive copying operations, with the result that a normal copying operation will be affected.

On the other hand, since it is required in a copying machine to maintain the temperature of the heating roller in a normal condition, the heating roller is generally designed to operate from the switching-on of a main (power source) switch. In this case, heat must be supplied from the heating roller to the whole peripheral surface of the pressure roller and it is necessary to rotate the heating roller and the pressure roller in contact with each other. In most cases, the rotational driving force is derived from a main motor intended for actuation of the main driving mechanism used for example to drive both a transfer sheet carrying belt mechanism and a fan mechanism, and thus rotation of the heating roller and the like at the time of preheating operation effects actuation of the above mentioned main driving mechanism with the result that the preheating operation will cause noise at a time other than during the copying operation. Such operation will result in the consumption of useless energy and occurrence of detrimental noise.

This invention intends to overcome these drawbacks and has one novel feature such that the heating roller and the pressure roller are contacted with each other under such low pressure as not to cause deformation of the surfaces of the rollers at the time of the inoperative and preheating condition of the machine, and operation of the main driving mechanism ceases at the time of preheating, the main driving mechanism being normally operated and both rollers being contacted with each other under high pressure only at the time of copying operation.

It is found that when both the rollers are rotated in the preheating operation at substantially the same speed as in the copying operation, sound produced by the rotational driving mechanism will be increased and cause unwanted noise, and that noise will occur to some extent both at the time of pressure contact and disengagement of the rollers depending upon the material of the surface rubber of the pressure roller. A second aspect of the present invention is that in order to avoid such drawbacks both the rollers are caused to rotate at a low speed at the time of preheating and are transferred to a normal state of rotation in synchronism with the starting of operation of the main driving mechanism at the time of copying operation.

Figure 2:
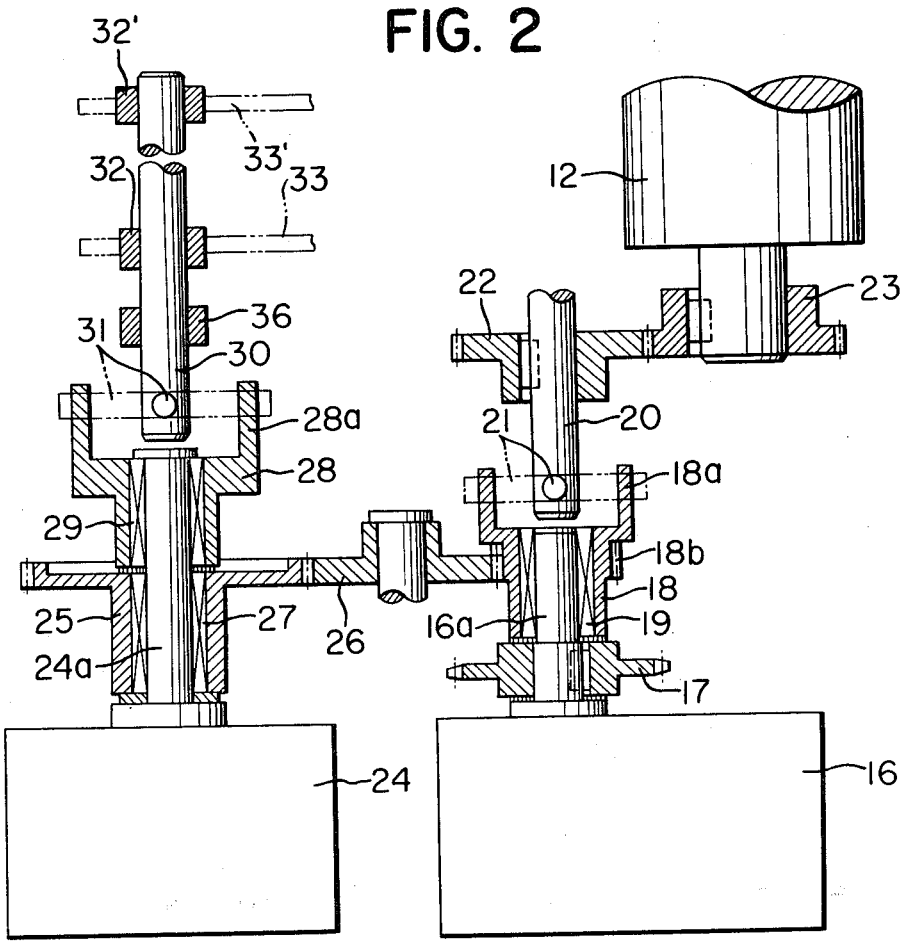
Figure 3:
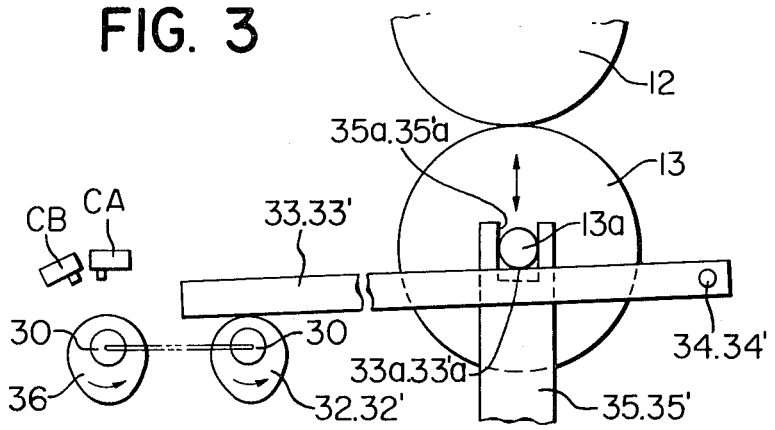
Figure 4:
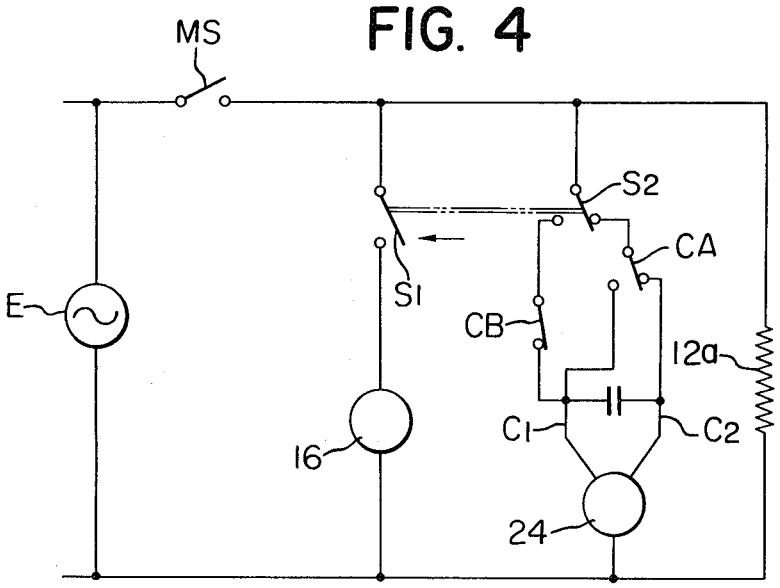
Figure 5:
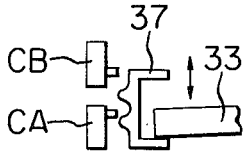

The invention will now be described in detail by reference to accompanying drawings in which:

FIG. 1 is a schematic illustration of a conventional copying machine to which the present invention is applied, FIG. 2 is a part of the main portion of the driving mechanism according to the present invention, shown partly in section, FIG. 3 is a diagrammatic view showing the relation of each of the cams shown in FIG. 2 to the control of pressure roller and the control switches, FIG. 4 is a circuit diagram of an example of a circuit for use in the embodiment of the invention, and FIG. 5 is an explanatory view of partial modification of a part of the invention.

Referring now to FIG. 1, a conventional electrostatic copying machine is schematically illustrated in which reference numeral 1 designates an original to be copied, 2 is a photosensitive drum, 3 is an optical unit, 4 is a charging electrode, 5 is a developing brush, 6 is a transfer electrode, 7 is a transfer sheet, 8 is a feed roller, 9 is a transfer sheet feeding roller, 10 is a separation pawl, 11 is a carrying belt for the transfer sheet subjected to image transfer process, 12 is a heating roller having a heater **12*a* (FIG. 4) inside thereof and provided with a metal surface and 13 is a pressure roller provided movably in the direction of an arrow in the manner described hereinafter and having its whole surface covered with a suitable material such as hard rubber. Reference numeral 14 designates a copying sheet receiving tray and 15 is a cleaning brush. A main driving mechanism for actuating the respective means inclusive of the carrying belt 11 at the time of normal copying operation is arranged to be actuated together with the heating roller 12 by a main motor 16** at the time of copying operation.

In FIG. 2, the main motor 16 is adapted to rotate clockwise and has its output shaft **16*a* to which a sprocket 17 is secured to transmit a driving force to the main driving mechanism such as the carrying belt 11 as by a chain (not shown). Reference numeral 18 designates a first coupling member mounted on the output shaft 16*a* of the main motor 16 through a first unidirectional transmitting clutch 19 which will be explained hereinafter. The first coupling member 18 is provided with a well-known coupling projection 18*a* on its tip and with a portion 18*b* on its central toothed portion. The first unidirectional transmitting clutch 19 is constituted as for example a well-known free wheel clutch and is arranged to be able to transmit a rotational force to the first coupling member 18 when the output shaft 16*a* of the main motor rotates clockwise. Reference numeral 20 designates an intermediate shaft arranged coaxially with said output shaft 16*a* and is journaled on the fixed portion of the machine by an appropriate means. Reference numeral 21 designates a second coupling member secured to the tip portion of the shaft 20 and may take the form of a single rod engageable with the forklike projection 18***a* of the first coupling member 18 at the rotational angle within a half revolution. Reference numeral 22 designates an intermediate gear secured to the intermediate shaft 20 and reference numeral 23 indicates a heating roller gear mounted on the end of the heating roller 12, which engages with the intermediate gear 22. Reference numeral 24 indicates a sub-motor constituted to rotate reversedly by conversion of input polarity as shown in FIG. 4. Sub-motor 24 has an output shaft 24*a* on which are mounted the second and the third unidirectional transmitting clutches 27 and 29 which will be described hereinafter.

Reference numeral 25 designates a sub-motor gear mounted on the output shaft 24*a* of the sub-motor through the second unidirectional transmitting clutch 27, which gear 25 is coupled to the toothed portion 18*b* of the first coupling member 18 through an idle gear 26. The second unidirectional transmitting clutch 27 is constituted for example, as a well-known free wheel clutch, which clutch 27 is adapted to be able to transmit a rotational force to the sub-motor gear 25 only when the output shaft 24*a* of the sub-motor rotates clockwise. Reference numeral 28 designates a third coupling member mounted on the output shaft 24*a* of sub-motor through the third unidirectional transmitting clutch 29, which coupling member 28 is formed with a forklike coupling projection 28*a*. The third unidirectional transmitting clutch 29 is constituted as a free wheel clutch similar to other unidirectional transmitting clutches 19 and 27 and is adapted to be able to transmit a rotational force to third coupling member 28 when the output shaft 24*a* of sub-motor rotates counterclockwise as opposed to the case of the second clutch 27. Reference numeral 30 designates a cam shaft arranged coaxially with the output shaft 24*a* of submotor and journaled rotatably on the fixed portion of the machine by an appropriate means. Reference numeral 31 designates a coupling member secured to the tip portion of the cam shaft 30 which coupling member is constituted in the form of a single rod to be able to engage the projection 28*a* of a forklike third coupling member 28 with a small play on either direction. Reference numerals 32 and 32' designate pressure cams secured on the cam shaft 30 at a distance generally corresponding to the width of the pressure roller 13 and are both provided with the same cam surface in the same direction as shown in FIG. 3. Reference numerals 33 and 33' designate pressure levers adapted to engage with the cams 32 which pressure levers are journaled on the fixed portion of the machine by the respective shafts 34 and 34' and have their intermediate portions 33*a* and 33*a'* engaging with the shaft 13*a* of the pressure roller 13.

In FIG. 3, reference numeral 35 and 35' designate retaining members for supporting the pressure roller 13 at their both ends, and which retaining members contain the shaft 13*a* of the pressure roller 13 by forklike grooves 35 and 35*a'*, as shown in the drawings.

Therefore, the pressure roller 13 is supported in such a manner that its own weight is supported by the pressure levers hereinafter designated by reference numeral 33 and that its horizontal movement is restricted by the forklike grooves 35*a*, 35*a'* of the retaining member. In this case, it is to be noted that the pressure cam 32 and the pressure roller 13 normally are positioned in such a relation that the pressure roller 13 contacts with the heating roller 12 on its peripheral surface under rather low pressure when the pressure lever 33 makes contact with the smaller diameter portion of the pressure cam 32, while the pressure roller 13 contacts with the heating roller 12 on its peripheral surface under rather high pressure when the pressure levers make contact with the larger diameter portion (i.e. the portion which a larger cam amount is given) of the pressure cam 32. Another cam 36 is a switch cam secured to the cam shaft 30 and is given a cam amount in substantially the same direction as the pressure cam 32. Therefore, either one of the pressure cams 32, 32' may act as the cam 36.

Referring to FIGS. 3 and 4, CA and CB designate control switches of normally closed type intended for control of the sub-motor 24. These control switches CA and CB are arranged in association with the cam 36 so that the switch CA is actuated by the larger diameter portion of the switch cam 36 prior to the switch CB and the switch actuating portion on the cam is positioned 180 degrees apart from the larger diameter portion of the switch cam 36 for the low pressure contact of the pressure roller 13 with the heating roller 12.

FIG. 4 illustrates a circuit for working the embodiment as shown in the preceding drawings in which E designates an A.C. power source, MS is a main switch for switching on or off the power source, and $S_1$ is a copying switch of normally opened type connected in series with the main-motor 16 and adapted to be kept in a closed state when a button for copying operation (not shown) is depressed until copying operation is completed for required number of copying paper as previously set. This copying switch $S_1$ may be of any well-known type.

The sub-motor 24 is fed with electric power through two input branch circuits $C_1$ and $C_2$ selectively and has its polarity so selected that it rotates counter-clockwise with the electric power fed through the first branch circuit $C_1$ while it rotates clockwise with electric power fed through the second branch circuit $C_2$.

The control switch CA is connected in the second branch circuit $C_2$ and the control switch CB is connected in the first branch circuit $C_1$. $S_2$ is a selection switch to change over the branch circuits $C_1$ and $C_2$. Switch $S_2$ is appropriately coupled in any well-known manner with the copying switch $S_1$, so that the selection switch $S_2$ connects to the second branch circuit $C_2$ when the copying switch $S_1$ is open, while the selection switch $S_2$ connects to the first branch circuit $C_1$ when the copying switch $S_1$ is closed. A heater 12*a* of the heating roller 12 is connected in parallel with the main motor 16 and starts heating upon switching on the main switch MS.

It is to be understood that the control switches CA and CB may be actuated as required by a sliding member 37 with a cam which is moved up and down by the end of one of the pressure lever 33 at its extreme positions of movement as shown in FIG. 5, instead of the camming action of the switch cam 36.

The copying machine with the above-mentioned mechanism operates as follows:

PREHEATING OPERATION

When the main switch MS is switched on prior to copying operation, the heater 12*a* of the heating roller 12 will produce heat and at the same time the sub-motor 24 will rotate clockwise by electric power being supplied through the second branch circuit $C_2$. As the second unidirectional transmitting clutch 27 is brought into operative condition, clockwise rotation of the output shaft 24*a* of the sub-motor 24 is transmitted to the submotor gear 25, so that the first coupling member 18 is also rotated clockwise through the intermediary of the idle gear 26. This clockwise rotation is transmitted to the heating roller 12 through the forklike projection 18*a*, the second coupling member 21, the intermediate shaft 20 and the intermediate gear 22 with the result that the heating roller 12 and the pressure roller 13, kept in contact therewith under low pressure as shown in FIG. 3, are rotated in the predetermined direction. In this case, however, rotation of the first coupling member 18 is not transmitted to the output shaft 16*a* of the main motor 16 due to the same direction of transmitting of the first unidirectional transmitting clutch 19. This results in that heat is supplied to the whole peripheral surface of the pressure roller 13 from the heating roller 12, under the condition that the main motor 16 is not rotated and the main driving mechanism such as the carrying belt is not actuated. In other words, heating operation is being carried out with little or no noise.

COPYING OPERATION

In such a condition as above-mentioned, when the number of copying sheets to be copied is set and the button for copying operation (not shown) is depressed, the copying switch $S_1$ is closed and the selection switch $S_2$ is switched to the first branch circuit $C_1$. As a result, the main motor 16 is rotated clockwise and the main driving mechanism such as the carrying belt is driven according to a given sequence through the sprocket 17. However, the sub-motor 24 is now fed with electric power through the selection switch $S_2$, the control switch CB and the first branch circuit $C_1$, and rotation of the motor 24 is converted from clockwise direction to counterclockwise direction. Then, rotational force of the main motor 16 is transmitted to the first coupling member through the first unidirectional transmitting clutch 19. It follows that the heating roller 12 is rotated from this instant by the force of the main motor 16. In this case, while the sub-motor gear 25 is rotated clockwise by the teeth portion 18*b* of the first coupling member 18, interference of the clockwise rotation of the sub-motor grear 25 with the counterclockwise rotation of the output shaft 24*a* of the sub-motor 24 is precluded by existence of the second unidirectional transmitting clutch 27; if otherwise, the rotation of the sub-motor 24 would be interfered with by the rotation of the output shaft 24*a*.

When the sub-motor 24 starts to rotate counterclockwise, the third unidirectional transmitting clutch 29 is brought into an operative or engaging condition, so that the third coupling member 28 is also rotated counterclockwise. As a result, the pressure cams 32 and 32' and the switch cam 36 are also rotated through the fourth coupling member 31 and the cam shaft 30. Accordingly, as the cam amount of the pressure cam 32 increases, the pressure lever 33 is moved upwards around its pivotal center or shafts 34, 34' with the result that the pressure roller 13 is strongly pressed against the surface of the heating roller 12. When the pressure cam 32 or the cam shaft 30 rotates about 180 degrees to a predetermined cam amount, the switch cam 36 rotating together therewith will press the control switch CA by its larger diameter portion so that connection is switched from the second branch circuit $C_2$ to the first branch circuit $C_1$. Immediately thereafter, another control switch CB is pressed by the larger diameter portion of the switch cam 36 so that the control switch CB is brought into opened and thus supply of electric power to the sub-motor 24 is completely cut off thereby to stop the sub-motor 24 with switch CA still in the $C_1$ circuit. As a result, the heating roller 12 will be rotated by the main motor 16 while being kept in intensive contact with the pressure roller 13.

This particular step is timed so that when the transfer sheet 7 reaches the position of the heating roller 12 after completion of steps of exposure, development and transfer, it passes between the rollers 12 and 13 kept in intensive contact with each other, is be subjected to thermal fixing process under a predetermined pressure and at a predetermined temperature.

Upon completion of copying operation for required number of sheets of copying paper, the operating button returns to its original position by means of a well-known means and at which time the copying switch $S_1$ and the selection switch $S_2$ return to the state shown in FIG. 4. Supply of electric power to the main motor 16 is accordingly cut, and the sub-motor 24 is fed with electric power through the selection switch $S_2$, the control switch CA and the first branch circuit $C_1$, so that the motor 24 is rotated counterclockwise again. Accordingly, the pressure cam 32 and the switch cam 36 which stand in the pressure condition of the pressure roller 32 will also rotate counterclockwise again and return to the position of FIG. 3. If the switch cam 36 is shaped to have such a cam amount that the cam 36 continues to press the control switch CA until the cam shaft 30 comes to the position shown in FIG. 3 or its vicinity, it is possible that the sub-motor 24 is allowed to rotate until the cam 36 reaches that position (the position of FIG. 3). The control switch CB has only to shift to its closed condition until the motor 24 rotates and reaches this particular position, and the cam is shaped to meet such requirement with respect to the switch CB. Alternately switches CA and CB may be controlled by the sliding member 37 which is moved up and down by the end of the pressure lever 33 as shown in FIG. 5.

When, when the sub-motor 24 is rotated counterclockwise until the cam groups are returned to the position of FIG. 3, the connection of the control switch CA is returned to the state of FIG. 3, and thus the sub-motor 24 rotates clockwise by electric power supplied through the selection switch $S_2$, the control switch CA and the second branch circuit $C_2$ until the following copying operation is effected. In this way, the heating roller 12 and the pressure roller 13 which are kept in contact with each other under low pressure by return of the pressure lever 33 to its original position, are rotated in the manner as above-mentioned. If the sub-motor 24 is designed to have a lower speed than that of the main motor, it will be possible to slow rotation of the rollers 12 and 13 at the time of preheating operation.

Various modifications can be made within the scope of this invention as follows:

In a first modification, use is made of an electromagnetic clutch and the realization of such an application can be conceived. A simple example of application is a system in which the unidirectional clutches employed in the embodiment are all replaced by the electromagnetic clutches which will be rendered operative or inoperative in synchronism with the period of operation of the main motor and the period of normal or reverse operation of the sub-motor.

It is to be noted that various other modifications can be made, all coming within the scope of the claims which follow.

According to the present invention, it will be appreciated that the copying machine can operate without noise even at the time of preheating operation and a thermal fixing method can be realized without waste of electric power and without deformation of the coated surface of the pressure roller.

What we claim is:

1. The method of controlling the fixing device of a copying machine in which a toner image bearing member is passed between a heating roller and a pressure roller so that the toner image is thermally fixed on the member by the rollers while the rollers are being rotated, which includes the steps of (1) normally maintaining said rollers in low-pressure contact, (2) preheating the heating roller, (3) actuating a reversible first sub-motor in one direction to rotate said two rollers, whereby the pressure roller will be preheated by the heating roller, (4) actuating a second main motor to rotate said two heated rollers to institute a copying operation, while substantially simultaneously reversing said motor in another direction and mechanically disconnecting the same from said rollers, (5) effecting high-pressure contact between said rollers by the action of said reversed sub-motor while said rollers are being driven by said main motor, (6) momentarily de-energizing said first sub-motor during the copying operation, and (7) de-energizing said main motor upon completion of the copying operation and substantially simultaneously again reversing said sub-motor into said one direction to return said rollers to low-pressure contact and maintain their continued rotation.

2. Method according to claim 1, in which the step of producing high-pressure contact between said rollers is accomplished by reducing the distance between the axes of the same.

3. Method according to claim 1, in which said rollers are rotated at a slower speed by the sub-motor than when rotated by the main motor.

4. In an apparatus for controlling the fixing device of a copying machine in which a toner image bearing member is passed between a heating roller and a pressure roller so that the toner image is thermally fixed on the member by the rollers while the rollers are being rotated, said rollers being in normal low-pressure contact when the image bearing member is not being passed through the rollers, and in combination with the source of power for said machine, the improvement which comprises a main motor, a reversible sub-motor having a pair of input terminals, a first power transmitting mechanism alternatively connecting said main motor and said sub-motor to one of said rollers for rotating the same, a second power transmitting mechanism for connecting said sub-motor to said first power transmitting mechanism upon rotation of said sub-motor in one direction, a cam shaft, a third power transmitting mechanism connecting said sub-motor to said cam shaft upon rotation of said sub-motor in another direction, means for heating said rollers from said source of power, means connecting one terminal of said sub-motor to the source of power for actuating said sub-motor in said one direction to initially rotate said rollers while under normal low-pressure contact, means connecting said main motor to the source of power to rotate said rollers and substantially simultaneously disconnecting said one terminal of the sub-motor from and connecting the other terminal thereof to said source of power for reversing said sub-motor, whereby said sub-motor becomes disengaged from said rollers and connected to said cam shaft through the operation of said second and third power transmission mechanisms, means including a cam on said cam shaft for producing high-pressure contact between said rollers when said cam shaft is rotated upon the reverse operation of said sub-motor, means for momentarily disconnecting said sub-motor from said source of power and means for disconnecting said main motor from said source of power and substantially simultaneously connecting said one terminal of said sub-motor to said source of power for rotating said sub-motor in its original direction, whereby said rollers are returned to their normal condition of low contact pressure and said sub-motor is reconnected to drive said rollers through said first and second power transmitting mechanisms.

5. Apparatus according to claim 4, in combination with a source of copying paper and means driven by said main motor for feeding copying paper to said rollers.

6. Apparatus according to claim 4, in which the means connecting said main motor to the source of power comprises a normally open copy-initiating switch intermediate said source of power and said motor, and means for connecting said one terminal of the sub-motor to the source of power comprises a normally closed switch linked to said copy-initiating switch, whereby when one switch is closed the other is open and vice versa.

7. Apparatus according to claim 6, in which said normally closed switch is a double-throw switch having a second normally open terminal to which contact is made when the normally closed portion thereof is opened, and in which the means for reversing said sub-motor comprises means including the second terminal on said switch connecting the other terminal of said sub-motor to the source of power.

8. Apparatus according to claim 7, in which the means for momentarily disconnecting said sub-motor comprises a normally closed switch, and means driven by said sub-motor to a predetermined position for opening said normally closed switch.

9. Apparatus according to claim 8, in which the means driven by said sub-motor for opening said normally closed switch comprises a second cam on said cam shaft.

10. Apparatus according to claim 4, in which the means for producing high-pressure contact between said rollers comprises a lever supporting said pressure roller, pivoted at one end and supported by said cam at its other end, whereby rotation of said cam urges said lever in a direction to press said pressure roller against said heating roller.

11. Apparatus according to claim 8, in which the means for producing high-pressure contact between said rollers comprises a lever supporting said pressure roller, pivoted at one end and supported by said cam at its other end, whereby rotation of said cam urges said lever in a direction to press said pressure roller against said heating roller.

12. Apparatus according to claim 11, in which the means driven by said sub-motor to a predetermined position for opening said normally closed switch includes said lever and means operated by said lever for actuating said switch.

* * * * *